US012031429B2

(12) United States Patent
Gray et al.

(10) Patent No.: US 12,031,429 B2
(45) **Date of Patent: *Jul. 9, 2024**

(54) PLUG ASSEMBLY SYSTEM FOR MONITORING CONDITION OF FLUID WITHIN WELLHEAD

(71) Applicant: Cameron International Corporation, Houston, TX (US)

(72) Inventors: Conor James Gray, Moyne (IE); Edmund McHugh, Longford Town (IE)

(73) Assignee: Cameron International Corporation

( * ) Notice: Subject to any disclaimer, the term of this patent is extended or adjusted under 35 U.S.C. 154(b) by 0 days.

This patent is subject to a terminal disclaimer.

(21) Appl. No.: 18/337,123

(22) Filed: Jun. 19, 2023

(65) Prior Publication Data

US 2023/0332500 A1 Oct. 19, 2023

Related U.S. Application Data

(63) Continuation of application No. 17/805,571, filed on Jun. 6, 2022, now Pat. No. 11,680,483, which is a (Continued)

(51) Int. Cl.

| | |
|---|---|
| ***E21B 49/08*** | (2006.01) |
| ***E21B 47/06*** | (2012.01) |
| ***E21B 47/07*** | (2012.01) |

(52) U.S. Cl.

CPC ..... *E21B 49/086* (2013.01); *E21B 47/06* (2013.01); *E21B 47/07* (2020.05)

(58) Field of Classification Search

CPC ..... E21B 34/02; E21B 33/068; E21B 33/03; E21B 33/038; E21B 33/04; E21B 33/043; E21B 43/12; E21B 47/06; E21B 47/12; E21B 47/00; F16K 15/06; F16K 15/18; F16L 29/02; H01F 38/14; H02J 50/10; H02J 50/80

See application file for complete search history.

(56) References Cited

U.S. PATENT DOCUMENTS

| | | | |
|---|---|---|---|
| 3,072,142 | A | 1/1963 | Yancey |
| 9,804,002 | B2 | 10/2017 | McHugh et al. |

(Continued)

FOREIGN PATENT DOCUMENTS

| | | | |
|---|---|---|---|
| CA | 2461402 | A1 | 9/2005 |
| NO | 333416 | B1 | 6/2013 |

(Continued)

*Primary Examiner* — Brandi N Hopkins
(74) *Attorney, Agent, or Firm* — Jeffrey D. Frantz

(57) ABSTRACT

A system includes a plug assembly having a housing configured to be positioned within a first passageway formed in a wellhead component. A channel is formed in the housing, and the channel is configured to enable fluid to flow from a bore of the wellhead component into the channel. A sensor is supported by the housing and is configured to measure a condition of the fluid within the channel. An annular seal is configured to extend between an outer surface of the housing and an inner surface of a second passageway formed in a flange that circumferentially surrounds at least part of the plug assembly while the flange is coupled to the wellhead component.

11 Claims, 6 Drawing Sheets

Related U.S. Application Data continuation of application No. 16/297,583, filed on Mar. 8, 2019, now Pat. No. 11,352,882.

(60) Provisional application No. 62/641,718, filed on Mar. 12, 2018.

(56) References Cited

U.S. PATENT DOCUMENTS

| | | | | |
|---|---|---|---|---|
| 11,352,882 | B2 | 6/2022 | Gray et al. | |
| 11,680,483 | B2 | 6/2023 | Gray et al. | |
| 2009/0000781 | A1 | 1/2009 | Bolding | |
| 2011/0011599 | A1 | 1/2011 | Nguyen et al. | |
| 2014/0216757 | A1 | 8/2014 | Kleppa | |
| 2014/0246197 | A1 | 9/2014 | Smith et al. | |
| 2017/0030160 | A1 | 2/2017 | Gray | |
| 2017/0044861 | A1* | 2/2017 | Guedes | E21B 34/02 |
| 2018/0010420 | A1* | 1/2018 | Shirley | F16K 15/063 |
| 2018/0179854 | A1* | 6/2018 | Healy | E21B 47/00 |

FOREIGN PATENT DOCUMENTS

| | | | |
|---|---|---|---|
| WO | 2003016673 | A1 | 2/2003 |
| WO | 2016046533 | A1 | 3/2016 |
| WO | 2018106119 | A2 | 6/2018 |
| WO | 2018160070 | A1 | 9/2018 |

* cited by examiner

PLUG ASSEMBLY SYSTEM FOR MONITORING CONDITION OF FLUID WITHIN WELLHEAD

CROSS-REFERENCE TO RELATED APPLICATIONS

This application is a continuation of U.S. patent application Ser. No. 17/805,571, filed on Jun. 6, 2022, which is a continuation of U.S. patent application Ser. No. 16/297,583, filed on Mar. 8, 2019, which claims the benefit of U.S. Provisional Application No. 62/641,718, filed Mar. 12, 2018.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead through which the resource is extracted. These wellheads may include a wide variety of components and/or conduits, such as various casings, hangers, valves, fluid conduits, and the like, that control drilling and/or extraction operations. It is now recognized that it would be desirable to monitor certain conditions within the wellhead (e.g., bore or annular space) during drilling and production operations.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure include a plug assembly, such as a valve removal (VR) plug assembly, that supports a sensor (e.g., pressure and/or temperature sensor) in a position that enables the sensor to monitor a condition (e.g., pressure and/or temperature) of a fluid within a bore of a wellhead component. To facilitate discussion, certain examples provided herein relate to a plug assembly that is configured to be positioned within a passageway (e.g., radially-extending outlet or channel) formed in the wellhead component, such as a tubing head or a casing head. However, it should be appreciated that the disclosed plug assemblies may be positioned within any other suitable component of a mineral extraction system, such as a Christmas tree, a surface manifold, or the like. Furthermore, the plug assembly may be utilized within mineral extraction systems that are land-based (e.g., a surface system) or sub-sea (e.g., a sub-sea system).

Figure 1:
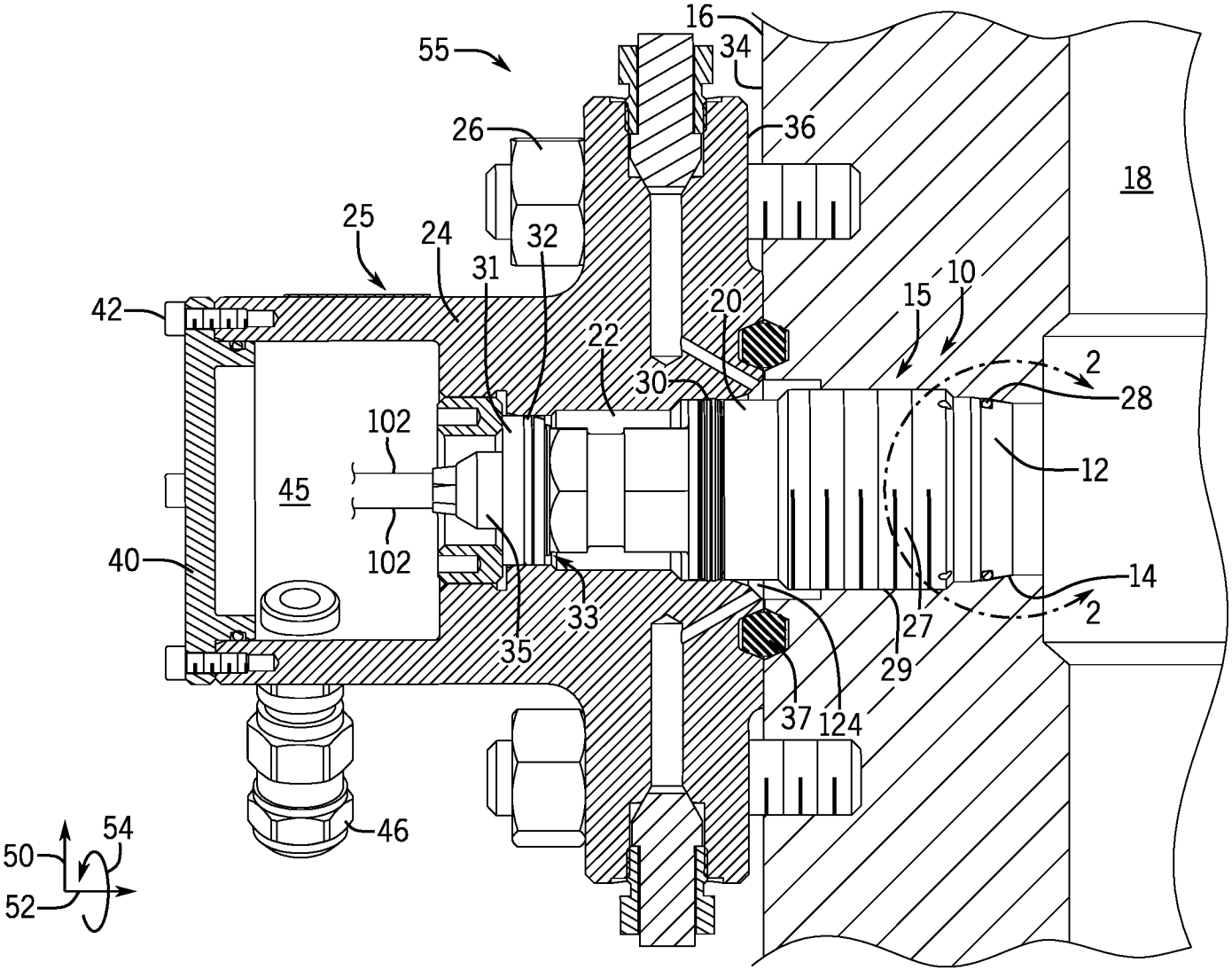
FIG. 1 is a partial cross-sectional side view of a plug assembly, in accordance with an embodiment of the present disclosure.

With the foregoing in mind, FIG. 1 is a partial cross-sectional side view of a plug assembly 10 (e.g., VR plug assembly), in accordance with an embodiment of the present disclosure. As shown, a first portion 12 (e.g., radially-inner portion, fluid-receiving portion, sensor head) of the plug assembly 10 is positioned within a passageway 14 (e.g., outlet or channel) formed in a wellhead component 16 (e.g., annular wellhead component, such as a tubing head) that defines a bore 18 that extends toward a sub-surface wellbore. A second portion 20 (e.g., radially-outer portion, outer sleeve) of the plug assembly 10 is positioned within the passageway 14 formed in the wellhead component 16 and also extends into a passageway 22 (e.g., channel) formed in a flange body 24 (e.g., annular flange body) of a flange 25 that is coupled to the wellhead component 16. Together, the first portion 12 and the second portion 20 form a housing 15 of the plug assembly 10.

As shown, the flange body 24 is coupled to the wellhead component 16 via one or more fasteners 26 (e.g., threaded fasteners, such as bolts). When the flange body 24 is coupled to the wellhead component 16, the passageways 14, 22 are aligned with one another to enable the plug assembly 10 to extend into and between the passageways 14, 22. In the illustrated embodiment, an outer surface (e.g., annular surface) of the second portion 20 includes threads 27 to couple (e.g., threadably couple via a threaded interface 29) to an inner surface (e.g., annular surface) of the passageway 14 formed in the wellhead component 16.

The illustrated plug assembly 10 also includes a first annular seal 28 (e.g., sealing ring) positioned about the first portion 12 of the plug assembly 10, as well as a second annular seal 30 (e.g., sealing ring) positioned about the second portion 20 of the plug assembly 10. A seal retainer 31 (e.g., annular retainer) supports a third annular seal 32 (e.g., sealing ring) and a fourth annular seal 33 (shown in FIGS. 3 and 4). Additionally, a fifth annular seal 37 (e.g., sealing ring) is positioned between an outer surface 34 of the wellhead component 16 and a wellhead-facing surface 36 of the flange body 24.

The first annular seal 28 may be configured to contact the inner surface (e.g., annular surface) of the passageway 14 to form a seal (e.g., annular seal) between the first portion 12 of the plug assembly 10 and the wellhead component 16. The second annular seal 30 may be configured to contact an inner surface (e.g., annular surface) of the passageway 22 to form a seal (e.g., annular seal) between the second portion 20 of the plug assembly 10 and the flange body 24. The third annular seal 32 may be configured to contact an inner surface (e.g., annular surface) of the passageway 22 to form a seal (e.g., annular seal) between the seal retainer 31 and the flange body 24. The fourth annular seal 33 (shown in FIGS. 3 and 4) may be configured to contact and form a seal between the seal retainer 31 and the second portion 20 of the plug assembly 10. The fifth annular seal 37 may be configured to contact and form a seal (e.g., annular seal) between the outer surface 34 of the wellhead component 16 and the wellhead-facing surface 36 of the flange body 24. Together, the first, second, third, fourth, and fifth annular seals 28, 30, 32, 33, 37 may provide multiple barriers to isolate the bore 18 defined by the wellhead component 16 from the environment. Furthermore, the first, second, third, and fourth annular seals 28, 30, 32, 33 may isolate the bore 18 from a chamber 45 defined within the flange body 24 and also from a coupling assembly 35 that facilitates coupling a sensor positioned within the plug assembly 10 to an external system, such as a controller 152 (FIG. 5). Additionally, the first portion 12 may also include a tapered shape (e.g., frustroconical shape) that may facilitate formation of a metal-to-metal seal between the first portion 12 and the passageway 14 of the wellhead component 12. The surface having threads 27 may be a tapered surface rather than a straight surface. In at least some embodiments, the threads 27 are provided on a tapered surface of the first portion 12 (rather than on the second portion 20) such that the first portion 12 can be threaded into the passageway 14 (e.g., via threads 29 on a mating tapered surface). Mating engagement of the tapered threaded surfaces may provide metal-to-metal sealing and, in at least some of these instances, such sealing is the first annular seal 28. It should be appreciated that some of all of the seals 28, 30, 32, 33, 37 may be provided in combination with various other seals in various other locations.

In the illustrated embodiment, a cap 40 is fastened (e.g., via one or more fasteners 42) to the flange body 24 to protect or to cover internal components within the passageway 22 or chamber 45. The cap 40 can be made of plastic or any other suitable material and inhibits dust or debris from entering the central passageway 22 extending through the flange body 24. The illustrated configuration may enable an operator to efficiently assemble, disassemble, and/or access the coupling assembly 35, cabling within the chamber 45, or certain components of the plug assembly 10 for inspection, repair, or other maintenance operations.

As shown, one or more glands 46 (e.g., cable glands) may be provided about the flange body 24 to support cables (e.g., one or more conductors) that electrically couple an internal component (e.g., a sensor supported within the plug assembly 10) to a controller (e.g., on a platform or surface). As discussed in more detail below, the components disclosed herein may operate to monitor a condition (e.g., pressure and/or temperature) within the bore 18 of the wellhead component 16. To facilitate discussion, the plug assembly 10, and the related components, may be described with reference to an axial axis or direction 50, a radial axis or direction 52, and a circumferential axis or direction 54. Furthermore, the plug assembly 10, the flange 25, and various other components (e.g., seals, circuitry, and cables) may form a plug system 55.

Figure 2:
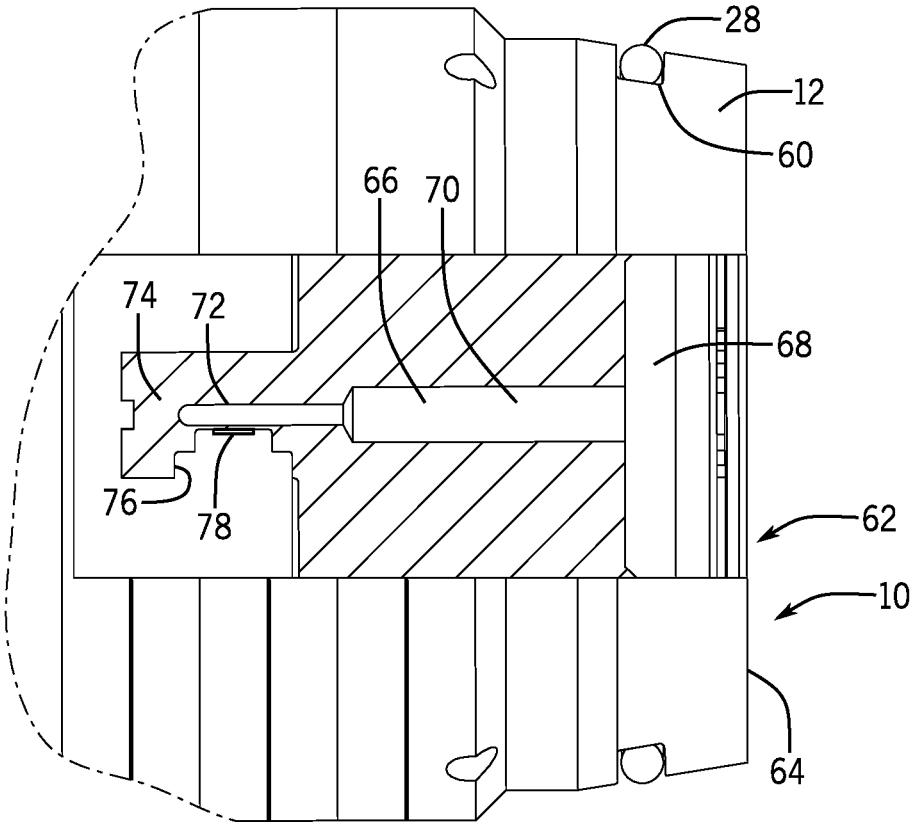
FIG. 2 is a cut-away side view of a portion of the plug assembly of FIG. 1 taken within line 2-2, in accordance with an embodiment of the present disclosure.

Additional features of the plug assembly 10 shown in FIG. 1 will be described with reference to FIGS. 2-5. For example, FIG. 2 is a cut-away side view of a portion of the plug assembly 10 of FIG. 1 taken within line 2-2, in accordance with an embodiment of the present disclosure. As shown, the first portion 12 of the plug assembly 10 includes a groove 60 (e.g., annular groove) to support the first annular seal 28. An opening 62 is formed in a first end surface 64 (e.g., radially-inner end surface) of the plug assembly 10 to enable fluid flow from the bore 18 (FIG. 1) into a channel 66 that extends (e.g., radially) into the first portion 12 of the plug assembly 10. In the illustrated embodiment, the channel 66 is a stepped-channel that includes various portions having an increasingly larger inner diameter along the radial axis 52. For example, the opening 62 and a first portion 68 of the channel 66 have a largest diameter, a second portion 70 of the channel 66 has an intermediate diameter, and a third portion 72 of the channel 66 has a smallest diameter. A wall 74 (e.g., annular wall) that circumferentially surrounds and defines at least part of the channel 66 (e.g., a part of the third portion 72 of the channel 66) may vary in thickness to facilitate monitoring conditions (e.g., pressure and/or temperature) of fluid within the channel 66. For example, as shown, an outer part of the wall 74 is removed or has a reduced thickness (e.g., relative to other portions of the wall 74; less than 0.5, 0.75, or 1 millimeter) to create a recess 76, and a sensor 78 (e.g., strain gauge and/or temperature sensor) configured to measure a pressure of a fluid within the channel 66 and/or a temperature of the fluid within the channel 66 may be positioned or supported within the recess 76. Thus, the wall 74 may separate or isolate the sensor 78 from the channel 66, while also enabling the sensor 78 to monitor the condition of the fluid (e.g., the reduced thickness enables the sensor 78 to detect pressure fluctuations within the channel 66).

Figure 3:
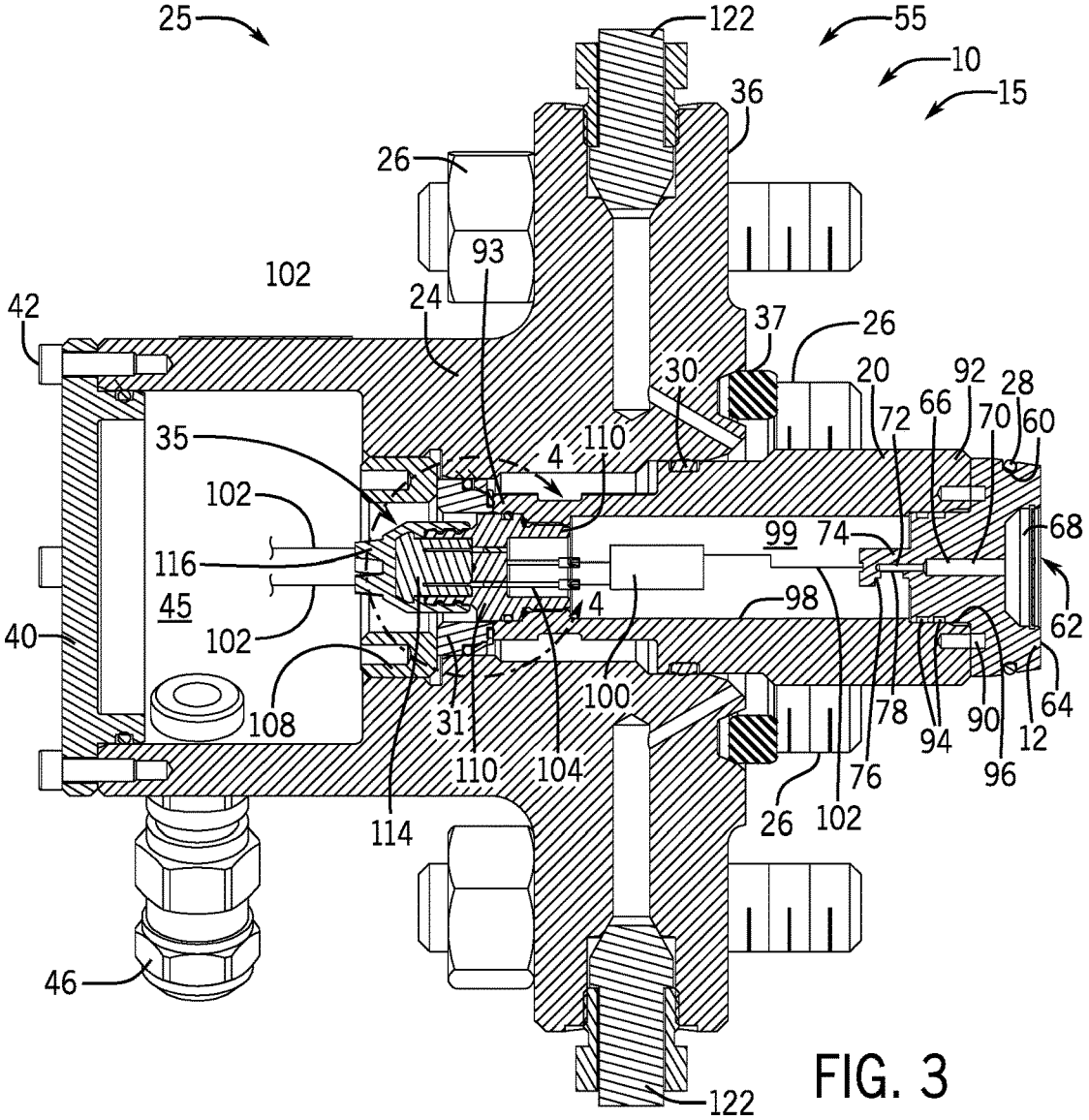
FIG. 3 is a cross-sectional side view of the plug assembly of FIG. 1, in accordance with an embodiment of the present disclosure.
Figure 4:
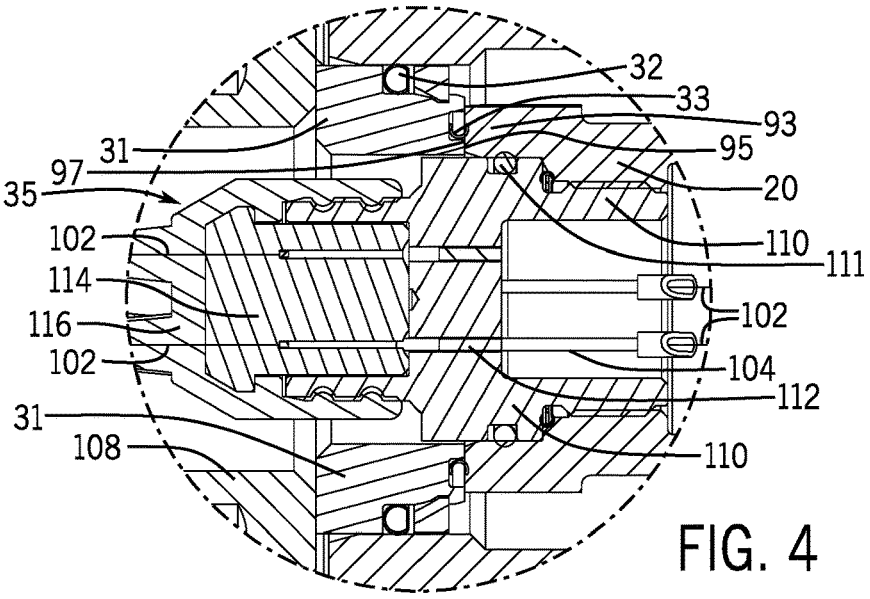
FIG. 4 is a cross-sectional side view of a portion of the plug assembly taken within line 4-4 of FIG. 3, in accordance with an embodiment of the present disclosure.
Figure 5:
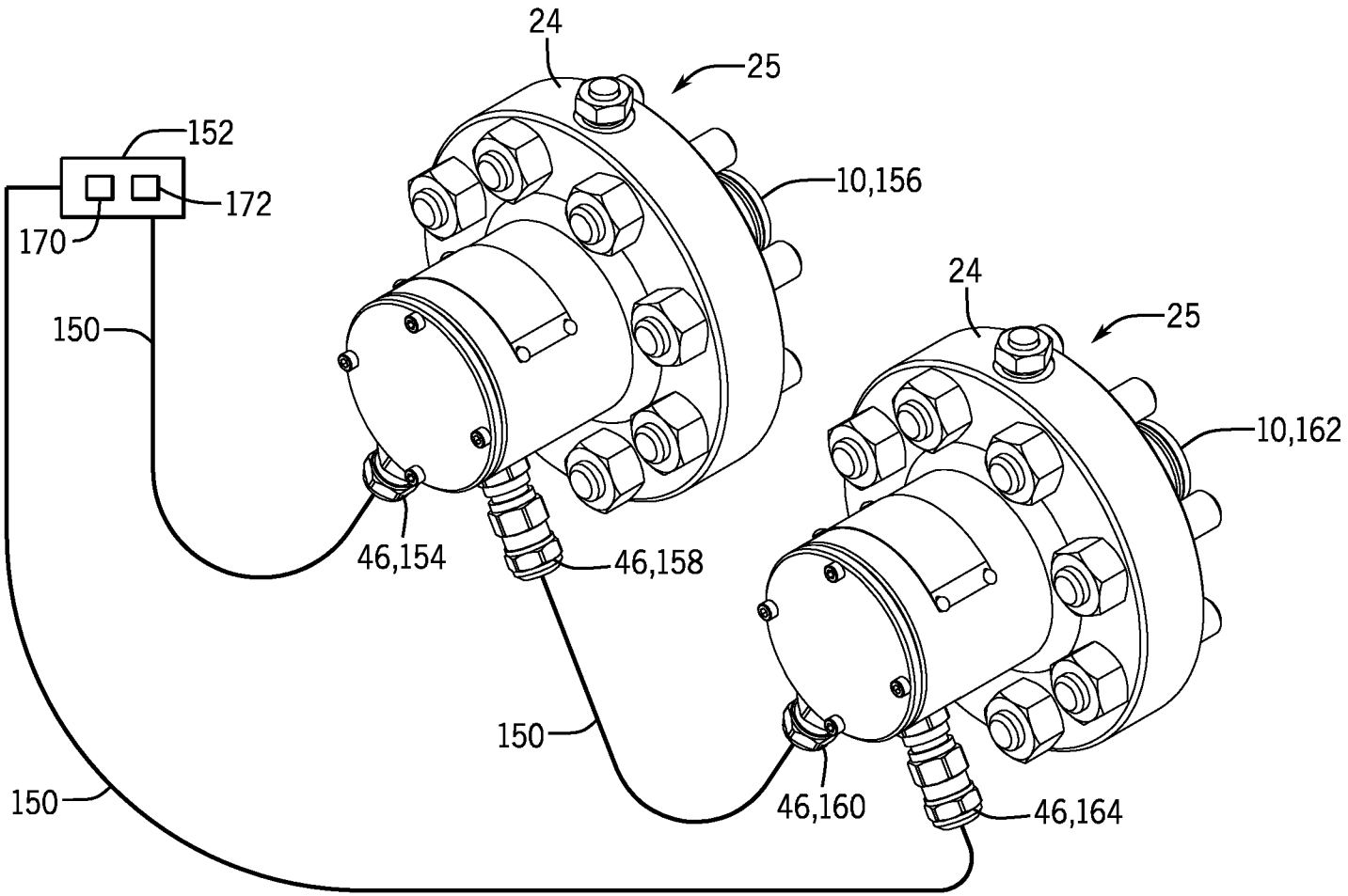
FIG. 5 is a perspective view of the plug assembly of FIG. 1 coupled to another plug assembly via a cable, in accordance with an embodiment of the present disclosure.

FIG. 3 is a cross-sectional side view of the plug assembly 10 of FIG. 1 and FIG. 4 is a cross-sectional side view of a portion of the plug assembly taken within line 4-4 of FIG. 3, in accordance with an embodiment of the present disclosure. FIG. 3 illustrates certain features shown and described above with respect to FIGS. 1 and 2, as well as various other features. As shown, the first portion 12 of the plug assembly 10 is configured to be positioned within the passageway 14 (FIG. 1) formed in the wellhead component 16 (FIG. 1) that defines the bore 18 (FIG. 1), and the second portion 20 of the plug assembly 10 is configured to extend between the passageway 14 (FIG. 1) and the passageway 22 formed in the flange body 24 that is configured to be coupled to the wellhead component 16 (FIG. 1), such as via one or more fasteners 26 (e.g., bolts, pins).

In the illustrated embodiment, the second portion 20 extends from a first end 92 (e.g., radially-inward end portion) to a second end 93 (e.g., radially-outward end portion). In some embodiments, the second portion 20 may be a one-piece or gaplessly continuous structure that extends from the first end 92 to the second end 93. Furthermore, the first end 92 is positioned radially-inwardly of the second annular seal 30, and the second end 93 is positioned radially-outwardly of the second annular seal 30. Thus, the second portion 20 extends through or across the second annular seal 30. It should be appreciated that one or more additional annular seals may be provided about the second portion 20, and in such cases, the second portion 20 extends through the one or more additional seals.

As shown, the first portion 12 and the second portion 20 are coupled together via one or more fasteners 90 (e.g., pins), and the first end 92 of the second portion 20 circumferentially surrounds at least part of the first portion 12. One or more additional annular seals 94 (e.g., sealing rings) may be positioned between an outer surface 96 (e.g., annular surface) of the first portion 12 and an inner surface 98 (e.g., annular surface) of the second portion 20 to form an annular seal between these surfaces 96, 98. It should be appreciated that the first portion 12 and the second portion 20 may be threadably coupled to one another (e.g., via corresponding threads in the surfaces 96, 98), welded to one another, or may be integrally formed with one another (e.g., one-piece or gaplessly continuous structure).

The illustrated plug assembly 10 also includes the first annular seal 28 positioned about the first portion 12 of the plug assembly 10, the second annular seal 30 positioned about the second portion 20 of the plug assembly 10, the third and fourth annular seals 32, 33 supported by the seal retainer 31, and the fifth annular seal 37 positioned at the wellhead-facing surface 36 of the flange body 24. As discussed above, the first annular seal 28 may be configured to form a seal (e.g., annular seal) between the first portion 12 of the plug assembly 10 and the wellhead component 16 (FIG. 1), the second annular seal 30 may be configured to form a seal (e.g., annular seal) between the second portion 20 of the plug assembly 10 and the flange body 24, the third annular seal 32 may be configured to form a seal (e.g., annular seal) between the seal retainer 31 and the flange body 23, the fourth annular seal 33 may be configured to form a seal (e.g., annular seal) between an axially-facing surface 95 (e.g., plug-facing or plug-contacting surface) of the seal retainer 31 and an axially-facing surface 97 (e.g., end surface) of the second portion 20 of the plug assembly 10, and the fifth annular seal 37 may be configured to form a seal (e.g., annular seal) between the wellhead-facing surface 36 of the flange body 24 and the wellhead component 16 (FIG. 1). Together, the first, second, third, fourth, fifth, and additional annular seals 28, 30, 32, 33, 37, 94 may isolate the bore 18 (FIG. 1) defined by the wellhead component 16 (FIG. 1) from the environment.

Furthermore, the first, second, third, fourth, and additional annular seals 28, 30, 32, 33, 94 may isolate the bore 18 (FIG. 1) from the chamber 45, as well as from other components (e.g., the coupling assembly 35 and the sensor 78 and associated circuitry) supported within a chamber 99 defined within the second portion 20 of the plug assembly 10, for example.

As noted above, the second portion 20 extends through or across the second annular seal 30. Furthermore, the housing 15 (i.e., the first portion 12 and the second portion 20) of the plug assembly 10 extends through or across the first and second annular seals 28, 30. That is, one end of the housing 15 is positioned radially inwardly of the first and second annular seals 28, 30, and a second end of the housing 15 is positioned radially outwardly of the first and second annular seals 28, 30. More particularly, in the illustrated embodiment, the first end surface 64 of the first portion 12 of the plug assembly 10 is positioned radially inwardly of the first and second annular seals 28, 30, and the second end 93 of the second portion 20 of the plug assembly 10 is positioned radially outwardly of the first and second annular seals 28, 30.

Additionally, the third and fourth annular seals 32, 33 supported by the seal retainer 31 provide an additional layer of isolation between the bore 18 and the environment. Having the third annular seal 32 positioned about the seal retainer 31 in combination with the fourth annular seal 33 supported on the axially-facing surface of the seal retainer 31 may enable the third and fourth annular seals 32, 33 to effectively block fluid flow across the seal retainer 31 even while the plug assembly 10 moves within the passageway 22 or is otherwise misaligned with the passageway 22, for example.

As shown, the plug assembly 10 may support sensor circuitry 100, which may include a circuit board coupled to the sensor 78 via one or more electrical conductors, such as cables 102. The sensor circuitry 100 may also be coupled to a receiving system (e.g., controller 152) via one or more cables (e.g., cables 102) and the coupling assembly 35. However, it should be appreciated that the plug assembly 10 may be devoid of a circuit board, and instead, cables may extend from the sensor 78 directly to the coupling assembly 35. As used herein, "cable" means any cable or wire suitable for transmitting electrical signals. Regardless of the manner in which the sensor 78 is electrically coupled to a receiving system (e.g., to enable the sensor 78 to send signals indicative of measured pressure and/or temperature to the receiving system), the sensor 78, the sensor circuitry 100, the coupling assembly 35, and associated cables 102 (e.g., all located within chambers 45, 99) are isolated from the bore 18 (FIG. 1) due to the arrangement of the various components of the plug assembly 10 (e.g., the first portion 10, the second portion 20, the first annular seal 28, the second annular seal 30, the third annular seal 32, the fourth annular seal 33, the additional annular seals 94, the wall 74). Thus, the disclosed configuration may enable an operator to access the coupling assembly 35, various cables 102, and/or certain components of the plug assembly 10 to inspect, repair, and/or carry out various maintenance operations (e.g., tightening the plug assembly 10 within the passageway 14 [FIG. 1] of the wellhead component 16 [FIG. 1], replacing the coupling assembly 35, repairing the sensor circuitry 100, or the like).

As noted above, in addition to the annular seals 28, 30, 32, 33, 94, the disclosed embodiments may include other features that facilitate such maintenance operations. For example, the cap 40 is fastened (e.g., via one or more fasteners 42) to the flange body 24 to protect or to cover internal components within the passageway 22 or chamber 45. Thus, an operator may adjust the one or more fasteners 42 to remove the cap 40 and access the interior of the flange body 24, such as to remove various other components supported within the flange body 24 and/or the second portion 20 of the plug assembly 10 to access the sensor circuitry 100 and/or the sensor 78, without exposing the environment to the fluid within the bore 18 (FIG. 1) (e.g., without removing the annular seals 28, 30, 32, 33, 37, 94 and/or while maintaining multiple annular seals 28, 30, 32, 33, 37, and/or 94 along each possible leak path between the bore 18 [FIG. 1] and the environment).

The various other components supported within the flange body 24 and/or the second portion 20 of the plug assembly 10 may include various sleeves and support structures. For example, the illustrated embodiment includes a spacer 108 (e.g., annular spacer) that may be inserted radially outward of the seal retainer 31. The spacer 108 may be threadably coupled to the flange body 24 and may hold the seal retainer 31 in place against the second portion 20 of the plug assembly 10. From the arrangement depicted in FIGS. 1 and 3, it will be appreciated that the spacer 108 is a retention device (e.g., a lock nut) that retains the housing 15 within the passageway 14 of the wellhead component 16. That is, the spacer 108 pushes the seal retainer 31 against the second portion 20 of the plug assembly 10 and prevents inadvertent movement of the plug assembly 10 radially outward from the passageway 14 of the wellhead component 16. This retention spacer 108 could have outer threads formed in the same direction as the threads 27 of the housing 15 (e.g., right-handed threads), but in at least one embodiment the spacer 108 is threaded in a direction opposite that of the threads 27. It will be further appreciated that the seal retainer 31 serves as an additional spacer in this arrangement, whether the seals 32 and 33 are included or omitted. Additionally, the illustrated embodiment includes a sleeve 110 (e.g., annular sleeve), which is positioned within and coupled (e.g., threadably coupled) to the second portion 20 of the plug assembly 10. That is, the second portion 20 circumferentially surrounds the sleeve 110. Although the sleeve 110 could have a metal body in some instances, in other embodiments the sleeve 110 is a non-metallic body, such as a ceramic or plastic body. The sleeve 110 may include one or more channels 112 (e.g., radially-extending channels) receiving conductive pins 104, and cables (e.g., cables 102) within the chamber 99 may be electrically coupled to a receiving system (e.g., controller 152) via the conductive pins 104. The cables within the chamber 99 can be connected to the conductive pins 104 via soldering or in any other suitable manner, and glass bead seals positioned proximate to or within the one or more channels 112 can be used to seal about the conductive pins 104, for example. In this illustrated embodiment, an annular sleeve seal 111 (e.g., sealing ring) is positioned between an outer surface (e.g., annular surface) of the sleeve 110 and an inner surface (e.g., annular surface) of the second portion 20 to form an annular seal between these surfaces. The annular sleeve seal 111 and the additional seals 94 may isolate the chamber 99 that contains the sensor 78 and the sensor circuitry 100 from the environment once the plug system 55 is fully assembled.

A connector block 114 and cover 116 are coupled to the sleeve 110. Together, the sleeve 110, the connector block 114, the cover 116, and the conductive pins 104 may form the coupling assembly 35 that couples cables 102 on opposite sides of the sleeve 110 in electrical communication (via the conductive pins 104) to enable the signals generated by the sensor 78 to be transmitted to the controller. Radially outward ends of the conductive pins 104 may be received in the connector block 114 (e.g., within sockets of the connector block 114) so as to be in electrical communication with the controller 152 or some other system via one or more additional cables 102 (e.g., wires). In one embodiment, these one or more additional cables 102 extend through the cover 116 and into the connector block 114 (e.g., in electrical contact with sockets receiving the conductive pins 104 in the connector block 114). The one or more additional cables 102 can extend radially outward from the cover 116 and pass through one or more of the glands 46 to an external system. In other instances, a strip connector, terminal board, or other connecting device may be used within or outside the flange body 24 to electrically couple the additional cables 102 to one or more further cables, such as cables 150 (FIG. 5). In the illustrated embodiment, none of the components of the coupling assembly 35 contact or seal against the flange body 24, but instead are positioned within the second portion 20 of the plug assembly 10. As shown, the coupling assembly 35 is positioned radially-outwardly of the annular seals 28, 30, 94 (e.g., relative to the bore 18 [FIG. 1] along the radial axis 52). Such a configuration may enable an operator to access and remove the components of the coupling assembly 35 without exposing the environment to the fluid within the bore 18 (FIG. 1).

In the illustrated embodiment, one or more glands 46 may be provided about the flange body 24 to support cables that couple the sensor 78 and associated sensor circuitry 100 to a controller (e.g., on a platform or surface). Thus, the sensor 78 may monitor a condition (e.g., pressure and/or temperature) within the bore 18 (FIG. 1) and generate signals indicative of the condition. The signals may be transmitted from the sensor 78 to the controller via the sensor circuitry 100, the conductive pins 104, and/or various cables, for example. As shown, the flange body 24 includes multiple test ports (closed with plugs 122) that are configured to inject fluid into a sealed space 124 (e.g., annular space) defined between the first, second, and fifth annular seals 28, 30, 37. The multiple test ports may enable testing of an integrity (e.g., sealing ability) of the first, second, and fifth annular seals 28, 30, 37. For example, if a pressure is not maintained within the sealed space 124 after injection of the fluid, one or more of first, second, or fifth annular seals 28, 30, 37 may need to be replaced. It should be appreciated that the annular seals 28, 30, 32, 33, 37, 94, 111 may be elastomer seals, metal (e.g., metal or metal alloy) seals, or a combination thereof (e.g., one seal may be an elastomer seal and another seal may be a metal seal). For example, in one embodiment, the first and second annular seals 28, 30 may be elastomer seals, while the third and fourth annular seals 32, 33 may be metal seals. Some embodiments use a dual-metal-sealing arrangement in which at least one of the first or second annular seals 28 or 30 is a metal seal and the third and fourth annular seals 32, 33 collectively serve within the flange body 24 as a second metal seal radially outward of the first metal seal.

FIG. 5 is a perspective view of the plug assembly 10 of FIG. 1 coupled to another plug assembly 10 via a cable 150 (e.g., one or more conductors may be electrically coupled to form the cable 150), in accordance with an embodiment of the present disclosure. Multiple plug assemblies 10 may be distributed about the wellhead component 16 (FIG. 1). For example, multiple plug assemblies 10 may be positioned at various locations along the axial axis 50 of the wellhead component 16 (FIG. 1). In such cases, it may be advantageous to electrically couple the respective sensors 78 supported in the multiple plug assemblies 10 in series (e.g., daisy chain).

Thus, the cable 150 may extend from a controller 152 (e.g., positioned at the platform) to a respective first gland 46, 154 of the first plug assembly 10, 156 (e.g., to provide power and/or control signals to the sensor 78 [FIG. 2]). The cable 150 may then pass through a respective second gland 46, 158 of the first plug assembly 10, 156 and extend to a respective first gland 46, 160 of the second plug assembly 10, 162. Finally, the cable 150 may pass through a respective second gland 46, 164 of the second plug assembly 10, 162. The cable 150 may extend to one or more additional plug assemblies 10 in a similar manner. Eventually, the cable 150 returns to the controller 152 to provide data collected from the respective sensors 78 (FIG. 2) of the multiple plug assemblies 10. Although described above as a cable 150, it will be appreciated that multiple cables 150 may be used to connect the controller 152 and the plug assemblies 10 together. It should also be appreciated that the controller 152 may include a processor 170 and a memory 172. The memory 172 may store instructions that, when executed by the processor 170, cause the processor 170 to process signals received from the sensors 78 (FIG. 2) to determine conditions (e.g., pressure and/or temperature) within the bore 18 (FIG. 1). In some embodiments, the instructions, when executed by the processor 170, cause the processor 170 to provide an output, such as a visual output via a display screen and/or an audible output via a speaker. The output may include a control signal to control a component of the mineral extraction system, such as to actuate a blowout preventer (BOP) to seal the bore 18 (FIG. 1) in response to the determination that the pressure within the bore 18 (FIG. 1) exceeds an acceptable pressure, for example.

Figure 6:
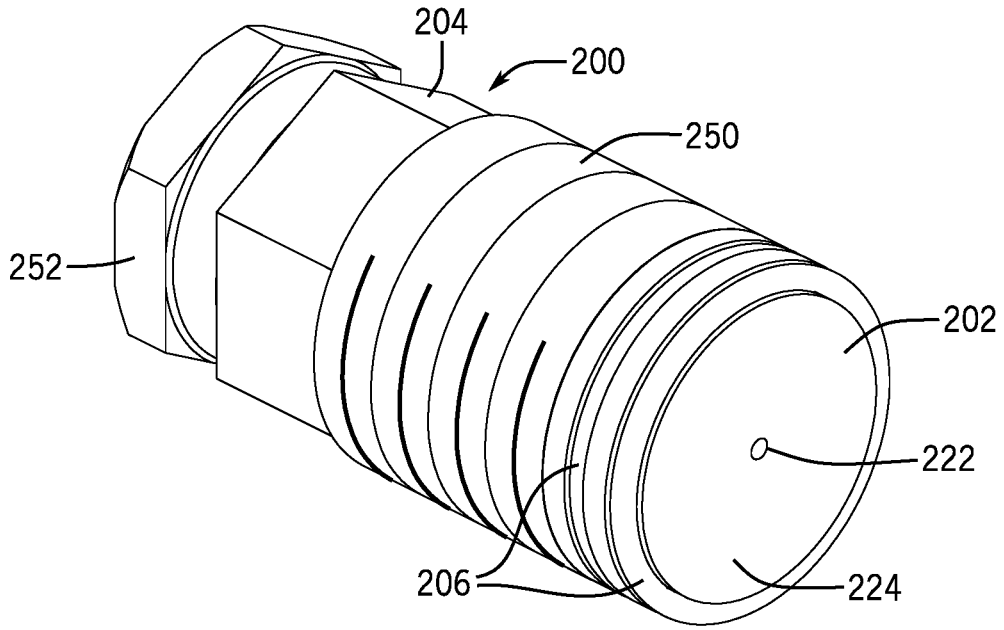
FIG. 6 is a perspective view of a plug assembly that may be used without a flange, in accordance with an embodiment of the present disclosure.
Figure 7:
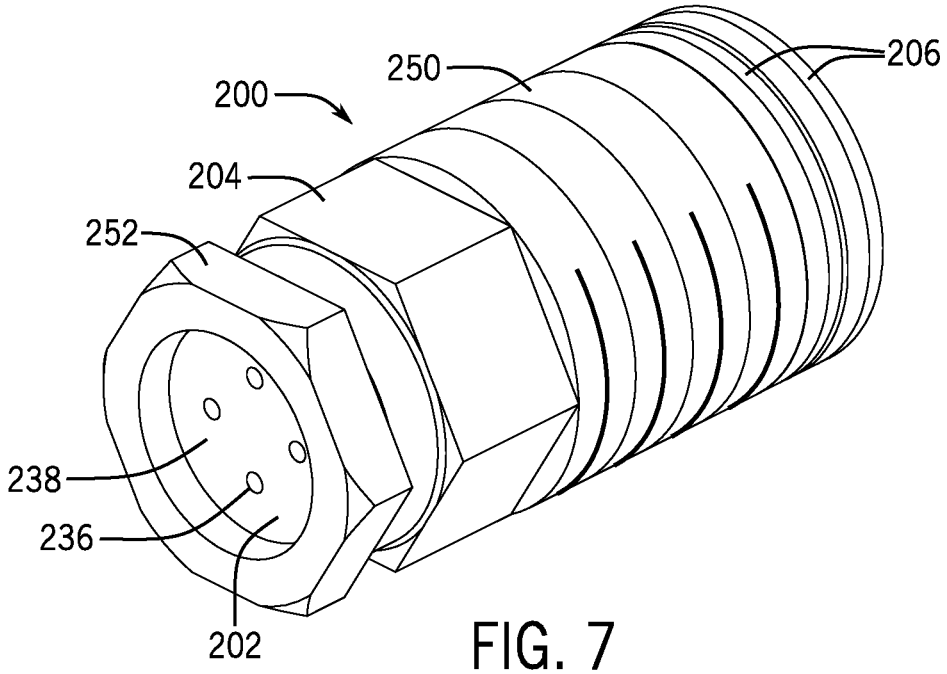
FIG. 7 is another perspective view of the plug assembly of FIG. 6, in accordance with an embodiment of the present disclosure.
Figure 8:
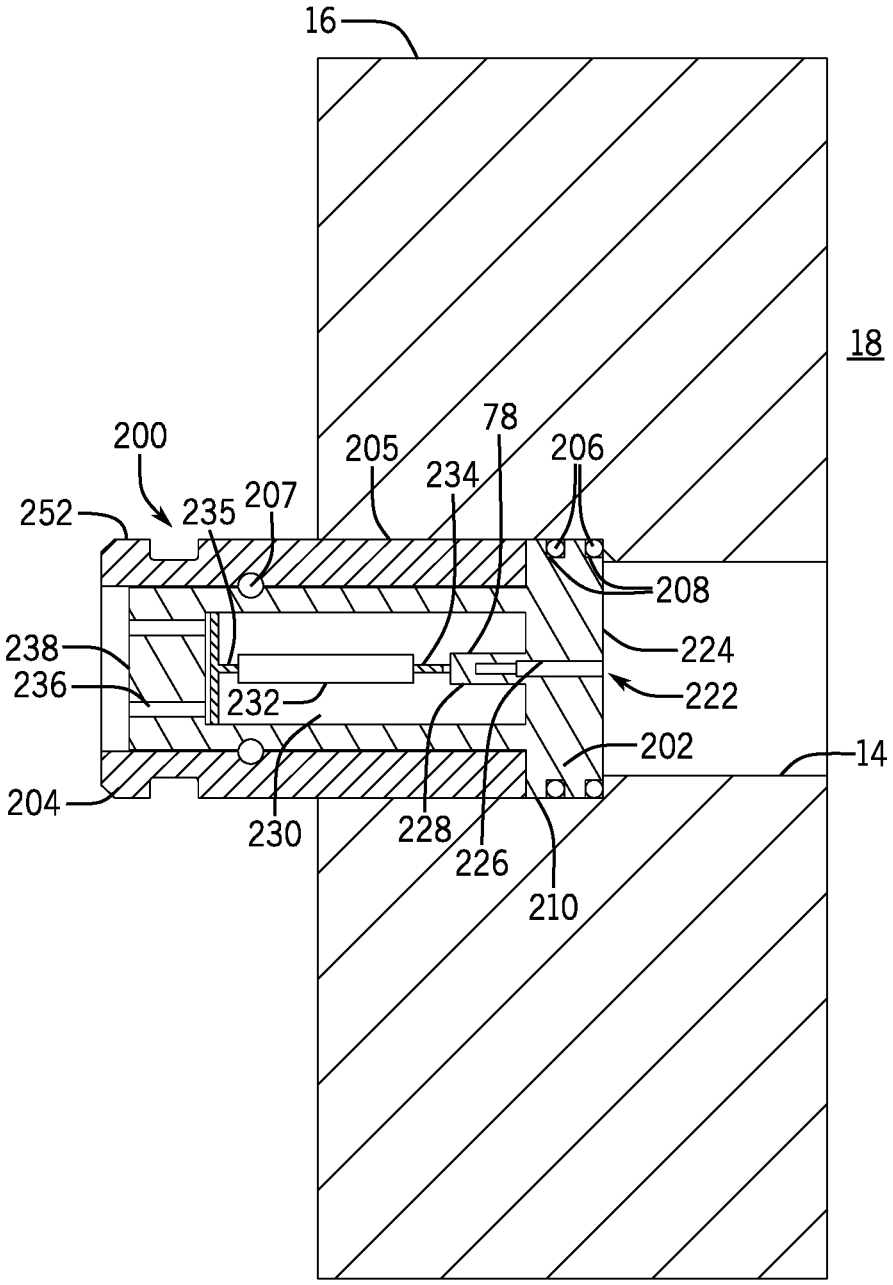
FIG. 8 is a cross-sectional side view of the plug assembly of FIG. 6 installed in a wellhead component, in accordance with an embodiment of the present disclosure.

FIGS. 6-8 illustrate an embodiment of a plug assembly 200 that may be used without a flange (e.g., without the flange 25 shown in FIGS. 1 and 3-5). In particular, FIGS. 6 and 7 are perspective views of an embodiment of the plug assembly 200, while FIG. 8 is a cross-sectional side view of the plug assembly 200 installed in a wellhead component. As shown, the plug assembly 200 is configured to be positioned within the passageway 14 of the wellhead component 16. In some embodiments, a portion of the plug assembly 200 may extend radially-outwardly from the wellhead component 16. The plug assembly 200 includes a first portion 202 (e.g., annular portion, sensor-supporting portion) and a second portion 204 (e.g., annular portion or outer sleeve). The second portion 204 may circumferentially surround at least part of the first portion 202, and the second portion 204 may be coupled (e.g., via a threaded interface 205) to the wellhead component 16. One or more bearings 207 may enable the first portion 202 and the second portion 204 to rotate relative to one another. The one or more bearings 207 may facilitate coupling the plug assembly 200 to the passageway 14 because the first portion 202 (and the components supported therein or coupled thereto) may not rotate, even while the second portion 204 rotates to threadably couple the plug assembly 200 to the passageway 14. Furthermore, the one or more bearings 207 may block movement of the first portion 202 (e.g., due to swirling fluid within the bore 18) from rotating the second portion 204, thereby maintaining the plug assembly 200 within the passageway 14 (e.g., the movement of the first portion 202 does not cause the second portion 204 to unthread from the passageway 14).

Multiple annular seals 206 (e.g., two or more annular sealing rings) are positioned about the first portion 202 of the plug assembly 200. In particular, the multiple annular seals 206 are supported within circumferentially extending grooves 208 formed in an outer surface 210 (e.g., annular surface) of the first portion 202, and the multiple annular seals 206 are configured to contact an inner surface (e.g., annular surface) of the passageway 14 to form a seal (e.g., annular seal) between the first portion 202 of the plug assembly 200 and the wellhead component 16. The annular seals 206 may be elastomer seals, metal (e.g., metal or metal alloy) seals, or a combination thereof. For example, a first annular seal 206 may be a metal seal, and a second annular seal 206 may be an elastomer seal.

An opening 222 is formed in a first end surface 224 (e.g., radially-inner end surface) of the plug assembly 200 to enable fluid flow from the bore 18 into a channel 226 that extends into the first portion 202 of the plug assembly 200. It should be appreciated that the channel 226 and the wall 228 that defines the channel 226 may have any of the features discussed above with respect to the channel 66 and the wall 74 in FIGS. 2 and 3. For example, the channel 226 may be a stepped channel, and a portion of the wall 228 may have a reduced thickness to form a recess to support the sensor 78 and to facilitate monitoring the condition of the fluid within the channel 226 using the sensor 78.

The first portion 202 may define a chamber 230 that supports or houses circuitry 232 (e.g., one or more circuit boards). The circuitry 232 may be coupled to the sensor 78, such as via one or more cables 234. The circuitry 232 may also be coupled to one or more cables 235 that are configured to extend through, or connect to conductive pins extending through, channels 236 (e.g., radially-extending channels) formed in a second end wall 238 of the first portion 202. For example, the one or more cables 235 may be electrically coupled to other cables (e.g., via conductive pins in the channels 236 with glass bead seals proximate to or within the channels 236) that extend to the controller (e.g., the controller 152) at the platform.

Regardless of the manner in which the sensor 78 is electrically coupled to the controller, the multiple annular seals 206 isolate the bore 18 from the sensor 78, the circuitry 232, and the environment. Accordingly, the plug assembly 200 may be utilized without a flange (e.g., the flange 25 [FIG. 1]). Thus, no structure is fastened to the outer surface of the wellhead component 16 in the vicinity of the plug assembly 200 and/or no annular seals are used to seal the outer surface of the wellhead component 16 to another component in the vicinity of the plug assembly 200. In some embodiments, the annular seals 206 between the first portion 202 and the passageway 14 of the wellhead component 16 are the only seals positioned about an outer circumference of the plug assembly 200. While the plug assembly 200 may be utilized without a flange, it should be appreciated that a covering or housing may be positioned (e.g., removably positioned) over the plug assembly 200.

As shown, the plug assembly 200 is configured to couple (e.g., threadably couple via threads 250) to the passageway 14 of the wellhead component 16. The plug assembly 200 includes the opening 222 formed in the radially-inner end surface 224 to enable fluid from the bore 18 to flow into the channel 226. Additionally, the channels 236 extend through the second end surface 238 of the first portion 202. The seals 206 circumferentially surround the first portion 202 of the plug assembly 200 to seal against the passageway 14 of the wellhead component 16. In the illustrated embodiment, a radially-outer end portion 252 of the second portion 204 may have a polygonal (e.g., hexagonal) cross-sectional shape to facilitate rotation of the plug assembly 200 to threadably couple the plug assembly 200 to the passageway 14 of the wellhead component 16.

It should be understood that various features of the plug assembly 200 shown in FIGS. 6-8 may be combined with the plug assembly 10 of FIGS. 1-5. For example, the sleeve 110 of the plug assembly 10 of FIGS. 1-5 may be utilized in the plug assembly 200 of FIGS. 6-8. That is, the channels 236 may extend through a component, such as the sleeve 110, which is physically separate from and is removably coupled to the first portion 202. Indeed, any of the various features described above with respect to FIGS. 1-8 may be combined in any suitable manner to form a plug assembly.

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a plug assembly, comprising:

a housing configured to be positioned within a first passageway formed in a wellhead component;

a channel formed in the housing, wherein the channel is configured to enable fluid to flow from a bore of the wellhead component into the channel;

a sensor supported by the housing and configured to measure a condition of the fluid within the channel;

a coupling assembly configured to electrically couple a cable that extends from the sensor or sensor circuitry supported within the housing to another cable outside the housing; and an annular seal configured to extend between an outer surface of the housing and an inner surface of a second passageway formed in a flange that circumferentially surrounds at least part of the plug assembly while the flange is coupled to the wellhead component.

2. The system of claim 1, wherein the housing is configured to threadably couple to the first passageway formed in the wellhead component.

3. The system of claim 1, comprising an additional annular seal configured to extend between the outer surface of the housing and a respective inner surface of the first passageway formed in the wellhead component.

4. The system of claim 1, wherein the housing comprises a first portion and a second portion coupled to one another, and the second portion circumferentially surrounds at least part of the first portion.

5. The system of claim 1, wherein the housing comprises a wall that defines the channel, and at least part of the wall is removed to form a recess that supports the sensor.

6. The system of claim 1, wherein the housing circumferentially surrounds at least a portion of the coupling assembly, and the coupling assembly is positioned radially-outwardly of the annular seal while the plug assembly is coupled to the wellhead component.

7. A system, comprising:

a plug assembly, comprising:

a housing configured to be positioned within a first passageway formed in a wellhead component;

a channel formed in the housing, wherein the channel is configured to enable fluid to flow from a bore of the wellhead component into the channel;

a sensor supported by the housing and configured to measure a condition of the fluid within the channel; and an annular seal configured to extend between an outer surface of the housing and an inner surface of a second passageway formed in a flange that circumferentially surrounds at least part of the plug assembly while the flange is coupled to the wellhead component, wherein the housing comprises a wall that defines the channel, and at least part of the wall is removed to form a recess that supports the sensor.

8. The system of claim 7, wherein the housing is configured to threadably couple to the first passageway formed in the wellhead component.

9. The system of claim 7, comprising an additional annular seal configured to extend between the outer surface of the housing and a respective inner surface of the first passageway formed in the wellhead component.

10. The system of claim 7, wherein the housing comprises a first portion and a second portion coupled to one another, and the second portion circumferentially surrounds at least part of the first portion.

11. The system of claim 7, further comprising a coupling assembly configured to electrically couple a cable that extends from the sensor or sensor circuitry supported within the housing to another cable outside the housing, wherein the housing circumferentially surrounds at least a portion of the coupling assembly, and the coupling assembly is positioned radially-outwardly of the annular seal while the plug assembly is coupled to the wellhead component.

* * * * *